US006041501A

United States Patent [19]

Suzuki et al.

[11] Patent Number: 6,041,501

[45] **Date of Patent: *Mar. 28, 2000**

[54] PROCESS FOR PRODUCING INK-JET RECORDING HEAD

[75] Inventors: Toshio Suzuki, Sagamihara; Masami Yokota, Kawasaki, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/807,595

[22] Filed: Feb. 27, 1997

[30] Foreign Application Priority Data

Feb. 29, 1996 [JP] Japan ..... 8-042878
Feb. 25, 1997 [JP] Japan ..... 9-040697

[51] Int. Cl.[7] ..... B41J 2/16

[52] U.S. Cl. ..... 29/890.1; 29/417; 216/27; 347/65; 347/203

[58] Field of Search ..... 29/25.35, 890.1, 29/413, 414, 417; 216/27, 33; 347/64, 65, 203

[56] References Cited

U.S. PATENT DOCUMENTS 5,365,645 11/1994 Walker et al. ..... 29/890.1 X
5,408,739 4/1995 Altavela et al. ..... 29/890.1 X
5,560,837 10/1996 Trueba ..... 216/27

FOREIGN PATENT DOCUMENTS 4191053 7/1992 Japan ..... 29/890.1
5147218 6/1993 Japan ..... 29/890.1

*Primary Examiner*—Peter Vo
*Attorney, Agent, or Firm*—Fitzpatrick, Cella, Harper & Scinto

[57] ABSTRACT

The process of the present invention for producing an ink-jet recording head is simple and does not require an additional solid layer on a first solid layer. The process comprises the steps of forming a solid layer in a space for forming a liquid path and a part of a liquid chamber on a first supporting member having thereon a discharge pressure-generating element used for discharging an ink, forming an opening portion at a position for forming an ink-supply opening in a second supporting member, placing the second supporting member on the first supporting member, providing a curable or thermoplastic resin for forming walls of the liquid path and the liquid chamber onto the first supporting member so that the solid layer formed on the first supporting member is covered with the resin, curing the resin in such a state that the resin is interposed between the first and second supporting members, cutting from the above the cured resin of the opening portion formed in the second supporting member until the solid layer to form an ink-supply opening and at least a part of a common liquid chamber, and removing the solid layer to form the liquid path defined by the first and second supporting members and the resin.

11 Claims, 6 Drawing Sheets

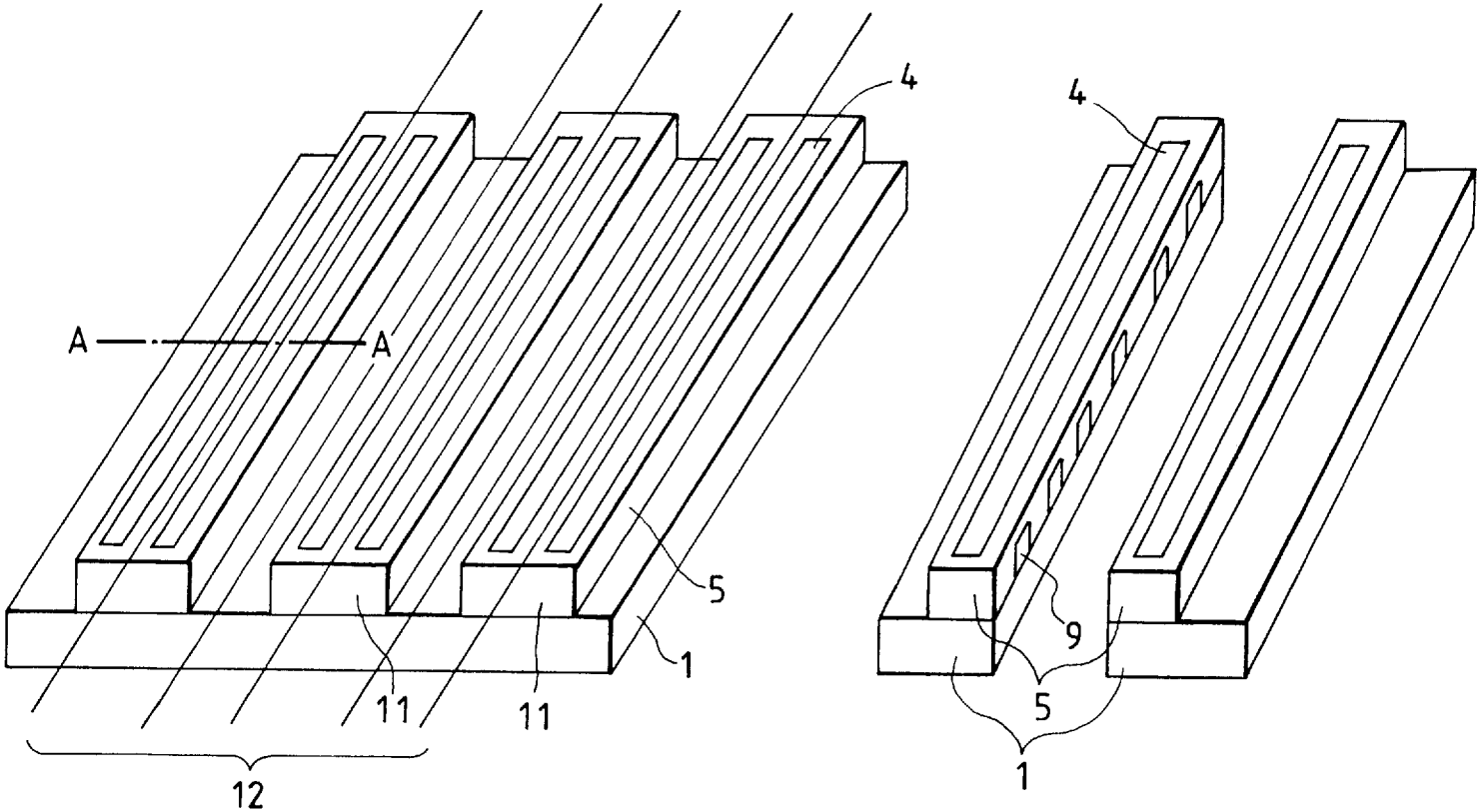
FIG. 5A - PRIOR ART
FIG. 5B - PRIOR ART

PROCESS FOR PRODUCING INK-JET RECORDING HEAD

BACKGROUND OF THE INVENTION

1. Field of the Invention

The present invention relates to a process for producing an ink-jet recording head which is mounted on an ink-jet recording apparatus and discharges droplets of a recording liquid toward a recording medium.

2. Related Background Art

As the means for performing recording on a recording medium such as paper sheets, an ink-jet recording apparatus equipped with an ink-jet recording head is widely used in apparatuses such as calculators, word processors, facsimile machines, copying machines, and printers, because the ink-jet recording apparatus can perform high speed recording without noise, and color image recording with ease.

In the conventional processes for producing an ink-jet recording head, for example, in the process disclosed in JP-A-62-253457, an ink-jet recording head is produced by forming a solid layer at an intended position for forming a liquid path on a supporting member, laminating thereon an activation energy ray-curable material layer and a second supporting member, irradiating the region except an intended position for forming a liquid chamber with an activation energy ray, removing the activation energy ray-curable material uncured at the intended position for forming the liquid chamber to thereby form the liquid chamber, and removing the solid layer formed at the intended position for forming the liquid path to thereby form the liquid path.

However, the above production process has the following problems:

1. The material for constructing the wall of the liquid path is limited to activation energy ray-curable materials capable of being patterned to form the liquid chamber, which severely restricts the choice of materials available.
2. When a common liquid chamber with larger height is formed so as to obtain intended ink droplet discharge performance of the ink-jet recording head, a larger thickness of the activation energy ray-curable material layer is required, which lowers yield due to lowering of patterning accuracy in patterning of the liquid chamber, and an expensive aligner is used for a long time enough to obtain a sufficient exposure amount to thereby raise the production cost.

The following process has been proposed in light of the above problems.

FIGS. 5A, 5B and 6A to 6G are perspective or sectional views for explaining a conventional process for producing an ink-jet recording head. In the process, as shown in FIG. 5A, a plurality of objects 11 to be separated later to thereby obtain opposed heads (hereinafter, opposed heads 11) are formed on a supporting member 1. Then, as shown in FIG. 5B, the opposed heads 11 are separated along cutting plane lines 12 to obtain individual heads. FIGS. 6A to 6G show production steps in sectional views taken along the line A—A in FIG. 5A.

As shown in FIG. 6A, firstly, a first solid layer 2 for forming a liquid path and a part of a liquid chamber is formed selectively by patterning or the like at the intended positions for forming the liquid path and the liquid chamber on a supporting member 1 provided with a discharge pressure-generating element 14.

As shown in FIG. 6B, a second solid layer 3 is formed at least at an intended position for forming the liquid chamber on the first solid layer 2 by printing or the like in order to obtain a sufficient volume of the liquid chamber and to obtain the gap between the supporting member 1 and a second supporting member 5 mentioned later.

As shown in FIG. 6C, a second supporting member 5 having a hole 4 for forming an ink supply opening later is placed on the second solid layer 3. Here, one opening end of the hole 4 provided in the second supporting member is closed by the second solid layer 3.

As shown in FIG. 6D, when the second supporting member 5 is placed on the second solid layer 3, small gaps 6 may exist at contacting portions between the second solid layer 3 and the second supporting member 5 owing to warpage or waving of the first supporting member 1 and the second supporting member 5, or owing to insufficient flatness or nonuniform thickness of the second solid layer 3. A curable resin 8 for forming the walls of the liquid path and liquid chamber will penetrate into the small gaps 6 by capillarity in the later step of injection of the curable resin 8. When the curable resin 8 penetrates into the gap 6, the curable resin 8 penetrated into the gap 6 becomes an extremely thin film. This thin curable resin film comes to be swollen by a removing liquid in the step of removing the first solid layer 2 and the second solid layer 3, or by an ink and then tends to exfoliate as dusts from the second supporting member 5 which clog the nozzles, or tends to remain in the form of a burr around an ink supply opening 4 to impair significantly ink refilling properties, disadvantageously. In an extreme case, the curable resin 8 spreads over the upper face of the second solid layer 3, and prevents removal of the second solid layer 3.

To solve the above problems, a flowable material 7 is filled into the gap between the second supporting member 5 and the second solid layer 3 prior to injection of the curable resin 8 for forming the wall of the liquid path.

As shown in FIG. 6E, the curable resin 8 for forming the walls of the liquid path and the liquid chamber is injected from an injection opening (not shown) between the first supporting member 1 and the second supporting member 5.

As shown in FIG. 6F, after curing the curable resin 8, the filler material 7 is removed, and the opposed heads is cut at the middle into two heads.

Finally, as shown in FIG. 6G, the first solid layer 2 and the second solid layer 3 are removed to obtain a head having a discharging portion (orifice) 9, a liquid path and a liquid chamber 10.

However, the above process has still problems as below:

(1) The step for forming the second solid layer 3 is required.

(2) The material for the second solid layer 3 is limited by many conditions that the material does not form an unnecessary product by reaction with the first solid layer 2, the material is incompatible with the curable resin 8, the material can be formed relatively thick (several ten microns or more), the material has high moldability, the second solid layer 3 can desirably be removed with the same removing liquid as used for removing the first solid layer 2, and so forth.

(3) A solid for filling the gap such as, filler material 7 must satisfy conditions, such as (i) the filler material has flowability to fill the gap 6 but does not spread out from the solid layer 3, (ii) the filler material is removable after the resin is injected and cured, (iii) the filler material does not retard the cure of the resin by mixing, (iv) the filler material has sufficient workability, and so forth.

SUMMARY OF THE INVENTION

The present invention has been accomplished to solve the above problems, and provides a simplified process for producing an ink-jet recording head in which the second solid layer is not required.

The above object is achieved by the production process of the present invention as described below.

The process of the present invention for producing an ink-jet recording head comprises the steps: forming a solid layer in a space for forming a liquid path and a part of a liquid chamber on a first supporting member having thereon a discharge pressure-generating element used for discharging an ink; forming an opening portion at a position for forming an ink-supply opening in a second supporting member; placing the second supporting member on the first supporting member; providing a curable or thermoplastic resin for forming walls of the liquid path and the liquid chamber onto the first supporting member so that the solid layer formed on the first supporting member is covered with the resin; curing the resin in such a state that the resin is interposed between the first and second supporting members; cutting from the above the cured resin of the opening portion formed in the second supporting member until the solid layer to form an ink-supply opening and at least a part of a common liquid chamber; and removing the solid layer to form the liquid path defined by the first and second supporting members and the resin.

The present invention as described above provides a process for producing an ink-jet recording head, the process comprising simple steps without requiring a conventionally formed second solid layer.

More specifically, the present invention has advantageous effects as described below:

1. An ink-jet recording head with high reliability is produced according to simple steps without using a mold material for forming the common liquid chamber, and without operation of filling the gap caused by use of the molding material.
2. An inexpensive ink-jet recording head with high precision is produced because the steps of light exposure and development of the curable resin are not necessary.
3. An ink-jet recording head having high reliability excellent in ink resistance, heat resistance and the like is produced because the curable resin can be selected irrespectively of the viscosity, wettability, and the like of the curable resin.
4. An ink-jet recording head having high-speed response characteristic is produced at a high yield without impairing ink-refilling properties and without closing the liquid path by dusts due to exfoliated extremely thin portion of the curable resin, because extremely thin portion of the curable resin is not formed.
5. An ink-jet recording head having high reliability without lowering the life of the element for generating a discharging pressure and trouble of the head due to corrosion by eluting an ink of a corrosive material is produced when a substrate made of a corrosive metal such as aluminum or the like is used as the second supporting member, because the inner wall of the opening portion in the second supporting member can be covered with the cured resin.
6. An inexpensive ink-jet recording head is produced according to simple steps because the additional step of filling the opening portion with the resin to close the opening portion is not required by injecting the resin from the opening portion. Further, since the distance from the injection opening (opening portion) of the curable resin to an outlet is short, the curable resin can be easily injected into a long head such as a multi-array type head having a long size in a direction of arranging nozzles and an ink-jet recording head with high quality without mixing bubbles into the resin can be produced in a high yield.

Additionally, since it is not required to provide an additional injection opening at the other portion than the effective portion of the ink-jet recording head, the size of the supporting member can be reduced or the number of the ink-jet head to be obtained from one supporting member can be increased, thereby realizing large cost down.

BRIEF DESCRIPTION OF THE DRAWINGS

FIGS. 5A and 5B are perspective views for explaining a conventional process for producing an edge-shooter type ink-jet recording head.

DESCRIPTION OF THE PREFERRED EMBODIMENTS

The process of the present invention for producing an ink-jet recording head is described in detail with reference to Examples and drawings.

EXAMPLE 1

FIGS. 1A to 1F are sectional views showing the steps of Example 1 of the process for producing an ink-jet recording head according to the present invention.

Figure 1A:
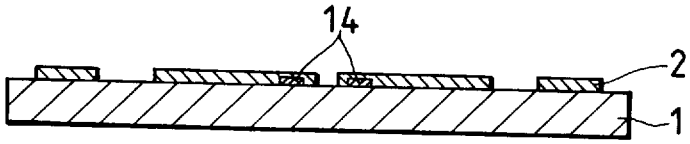
FIGS. 1A, 1B, 1C, 1D, 1E and 1F are sectional views for explaining the production steps of Example 1of the present invention.

As shown in FIG. 1A, on a first supporting member 1 having discharge pressure-generating elements 14 thereon, a first solid layer 2 is formed at the intended position for forming a liquid path and a liquid chamber communicating with the liquid path. Here, an aluminum substrate covered with corrosion-resistant coating was used as the first supporting member 1. In this Example, since no second solid layer is provided, the first solid layer 2 is simply referred to as a solid layer 2.

This solid layer 2 is removed after the steps mentioned below, and the space formed by the removal of the solid layer constitutes at least the liquid path. In this Example, the solid layer 2 was formed from MF-58 manufactured by Tokyo Ohka K.K. which is a positive photoresist.

Figure 1B:
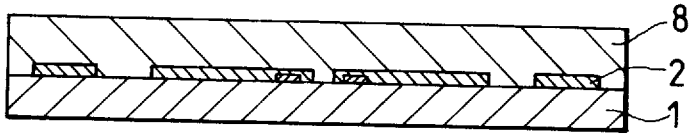

As shown in FIG. 1B, a spacer (not shown) of about 100 $\mu$m thick was provided at the position where will become unnecessary portion after the separation by cutting so that a second supporting member 5 can be placed on the first supporting member 1. Then, a curable resin 8 was applied onto the first supporting member so as to cover the solid layer 2. The thickness of the curable resin applied was set to 100 $\mu$m which is the same as the thickness of the spacer. A dicing tape was used as the spacer.

Figure 1C:
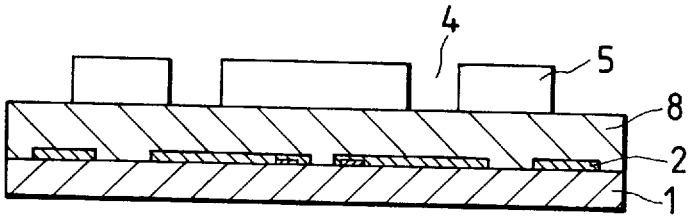

As shown in FIG. 1C, the second supporting member 5 having an ink-supply opening 4 was placed via the spacer and the curable resin 8 on the first supporting member 1. As the second supporting member 5, an aluminum cover plate having a surface subjected to corrosion-resistance treatment was used.

Figure 1D:
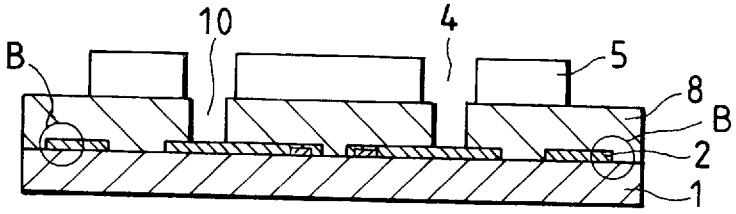

As shown in FIG. 1D, the cured resin 8 under the ink-supply opening is cut off until the solid layer 2 by a diamond saw. The space formed by cutting off the resin 8 becomes the liquid chamber 10. If connection pads are provided at the positions B for connection with another device, the resin on these positions is also removed by cutting.

Figure 1E:
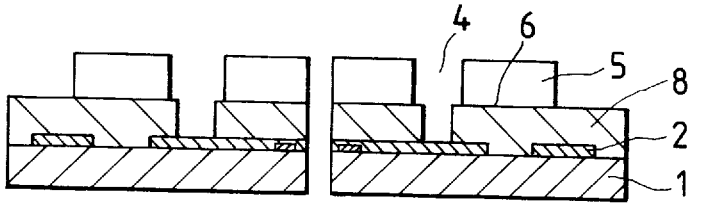

As shown in FIG. 1E, the resulting object (opposed heads) is cut by a diamond saw.

Figure 1F:
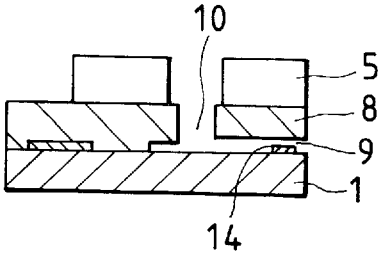

As shown in FIG. 1F, the solid layer 2 is removed by using ethylcellosolve as the removal liquid to obtain a discharging portion and an ink liquid path.

EXAMPLE 2

Figure 2A:
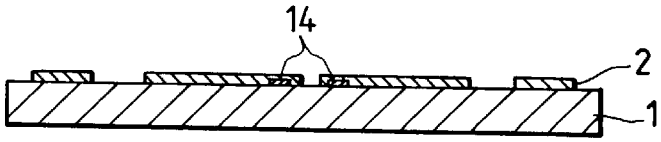
FIGS. 2A, 2B, 2C, 2D, 2E, 2F and 2G are sectional views for explaining the production steps of Example 2 of the present invention.
Figure 2B:
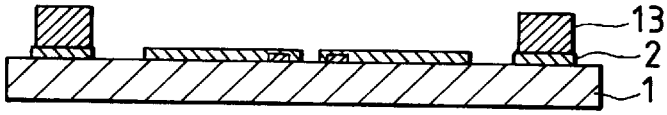

The steps of Example 2 are shown in FIGS. 2A to 2G. The steps of Example 2 are mainly different from the steps of Example 1 shown in FIGS. 1A to 1F in that the ink-supply openings of the second supporting member are preliminarily filled with a curable resin 8. In the same manner as in Example 1, a first solid layer 2 is formed at a position for forming a liquid path and a liquid chamber communicating with the liquid path on a first supporting member 1 having discharge pressure-generating elements 14 thereon (FIG. 2A). A spacer 13 for placing the second supporting member above the first supporting member is provided thereon (FIG. 2B). In FIG. 2B, the spacer 13 is placed near the head. The spacer may be placed at the end of the first supporting member. Otherwise, projections are provided on the first supporting member 1 or the second supporting member 5 to serve as the spacer.

Figure 2C:
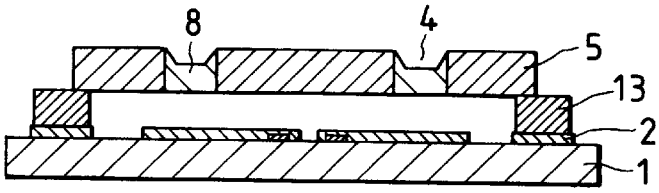
Figure 2D:
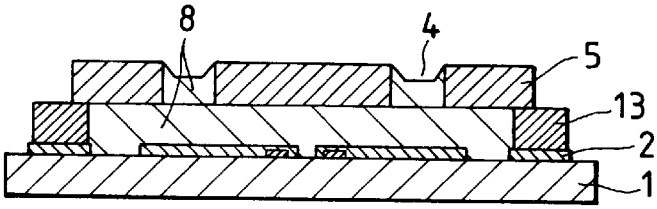
Figure 2E:
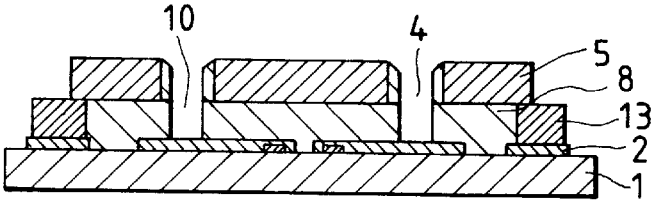
Figure 2F:
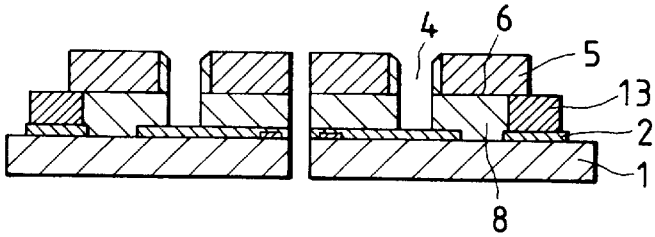
Figure 2G:
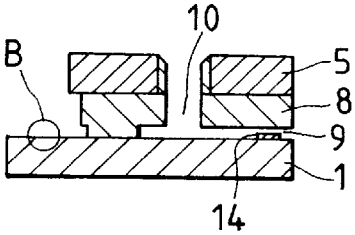
Figure 3A:
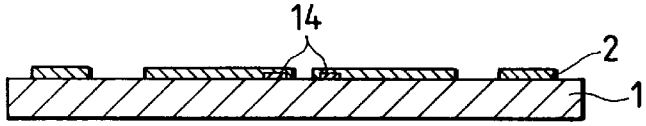
FIGS. 3A, 3B, 3C, 3D, 3E, 3F, 3G and 3H are sectional views for explaining the production steps of another embodiment of Example 2 of the present invention.
Figure 3B:
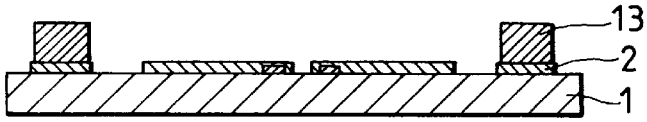
Figure 3C:
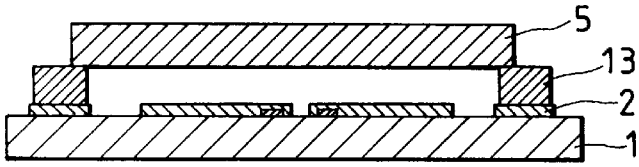
Figure 3D:
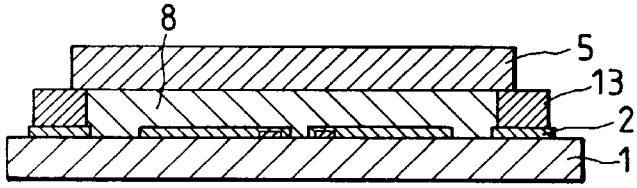
Figure 3E:
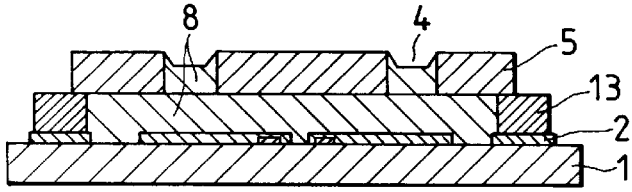
Figure 3F:
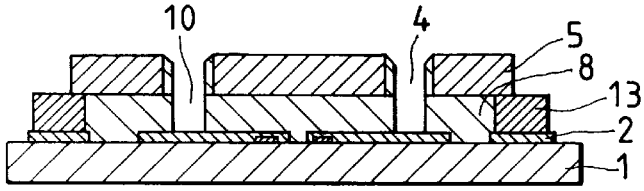
Figure 3G:
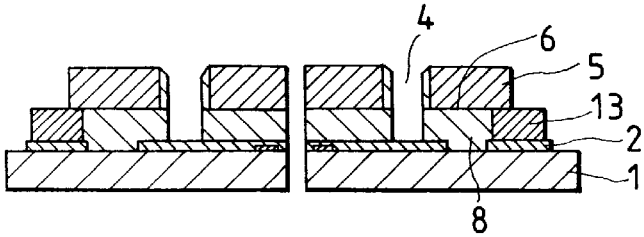
Figure 3H:
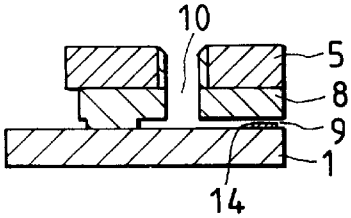

As shown in FIG. 2C, in this Example, the opening portion 4 to become an ink-supply opening is preliminarily filled with a curable resin 8. Next, in the same manner as in Example 1, the curable resin is injected into the gap between the first and the second supporting members (FIG. 2D). After curing the resin, the resin of the opening portion in the second supporting member is cut at a width smaller than the width of the opening portion from the above until the solid layer by a diamond saw so that the diamond saw does not contact with the inner wall of the opening portion in the second supporting member, thereby forming the ink-supply opening and the liquid chamber (FIG. 2E). Then, in the same manner as in Example 1, the resulting object (opposed heads) is cut and separated (FIG. 2F). The solid layer 2 and the spacer 13 are simultaneously removed by ethylcellosolve to expose the connection pad at the position B to the outside (FIG. 2G).

According to the above process, even when a corrosive metal such as aluminum or the like is used as the second supporting member, the corrosion of the inner wall of the ink-supply opening of the second supporting member can be inhibited without subjecting the inner wall to a particular treatment such as a corrosion resistant coating because the inner wall of the opening portion in the second supporting member is not exposed by covering the inner wall with the resin.

By providing the removable spacer on the supporting member and placing the second supporting member thereon so that the end of the second supporting member is not positioned above the portion B, it is not necessary to cut the second supporting member in order to expose the portion B.

In this Example, the opening portion 4 to become the ink-supply opening is formed in the second supporting member before placing the second supporting member on the first supporting member. Otherwise, as shown in FIGS. 3A to 3H, the portion of the second supporting member to become the ink-supply opening may be cut to form the opening portion in the second supporting member after injecting the curable resin 8 into the gap between the first and the second supporting members. In this case, it is necessary to fill the opening portion with the curable resin and then carry out the cut work of the resin for forming the ink-supply opening and the liquid chamber.

EXAMPLE 3

FIGS. 4A to 4G are sectional views showing the steps of one example of the process of the present invention. The process for producing an ink-jet recording head according to the present invention is explained below with reference to FIGS. 4A to 4G.

Figure 4A:
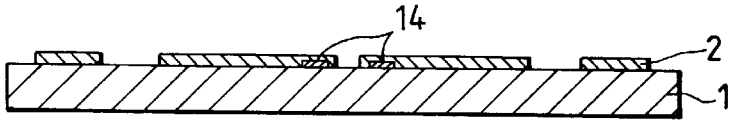
FIGS. 4A, 4B, 4C, 4D, 4E, 4F and 4G are sectional views for explaining the production steps of Example 3 of the present invention.

As shown in FIG. 4A, on an aluminum substrate (first supporting member 1) having a discharge pressure-generating element 14 thereon, a first solid layer 2 is formed at an intended position for forming a liquid path and a liquid chamber communicating with the liquid path.

This solid layer 2 is removed after the steps mentioned below, and the space formed by the removal of the solid layer constitutes at least the liquid path. In this Example, the solid layer 2 was formed from PMER-900 manufactured by Tokyo Ohka K.K.

Figure 4B:
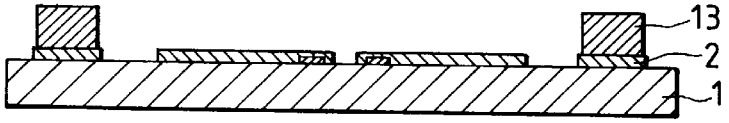

As shown in FIG. 4B, a spacer 13 having a desired thickness, for example about 50 $\mu$m to 200 $\mu$m is provided at the unnecessary portion of the first supporting member (i.e., the portion outside the effective portion of ink-jet recording head). In this Example, for example, a tape having a thickness of 200 $\mu$m was provided as the spacer at the unnecessary portions of the ends of the substrate.

Figure 4C:
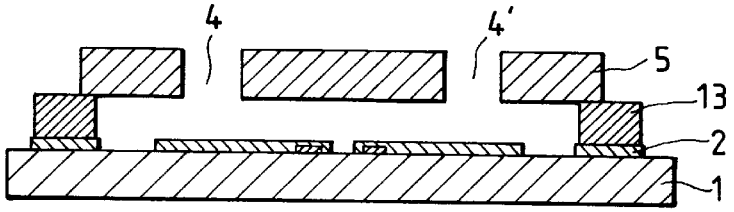

As shown in FIG. 4C, the second supporting member 5 made of aluminum having an opening portion 4 with a width lager by about 0.1 mm to 0.5 mm than the width of an ink-supply opening and a common liquid chamber is placed at the intended position for forming the ink-supply opening and a common liquid chamber.

Figure 4D:
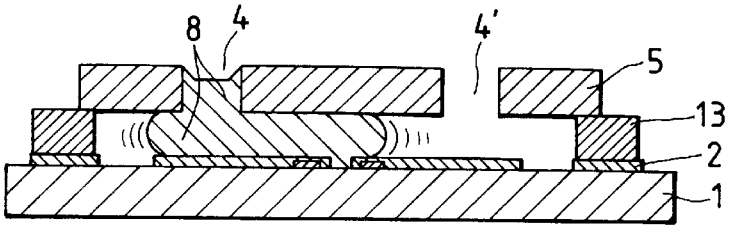

As shown in FIG. 4D, an epoxy type cold-curable resin 8 is dropped from one opening portion 4 provided in the second supporting member 5 by a known means such as a dispenser and is injected into the gap between the first supporting member 1 and the second supporting member 5 by capillarity. The dispenser is moved in the direction of arranging nozzles while dropping the resin. The dropping of the curable resin 8 and the moving of the dispenser are continued until at least a part of a second opening portion 4' opposite to the opening portion 4 through which the resin is dropped is filled with the resin. Then, the curable resin 8 is also dropped in the opening portion 4' so that the opening portion 4' is completely filled with the resin. Then, the resin is cured by standing at ambient temperature or heating.

Figure 4E:
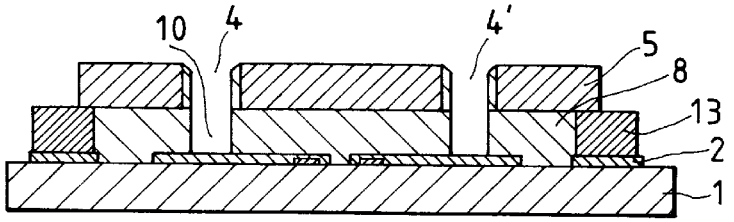

As shown in FIG. 4E, the cured resin in the opening portion is cut off by a diamond saw until the solid layer 2. The space formed by cutting off the resin 8 forms the ink-supply opening and the liquid chamber 10. If connection pads are provided at the positions B for connection with another device, the resin on these positions is also removed by cutting.

Figure 4F:
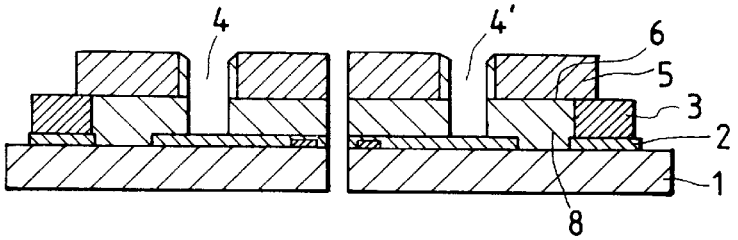

As shown in FIG. 4F, the resulting object (opposed heads) is cut by a diamond saw.

Figure 4G:
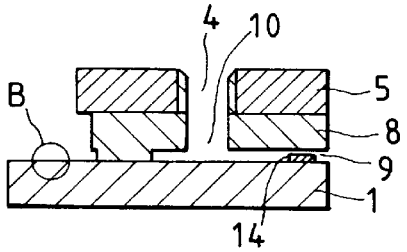
Figure 6A:
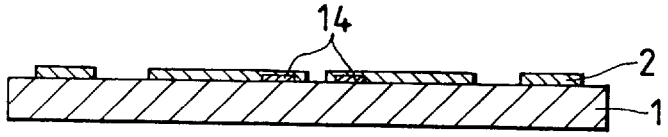
FIG. 6A PRIOR ART
FIGS. 6A, 6B, 6C, 6D, 6E, 6F and 6G are sectional views for explaining a conventional process for producing ink-jet recording head.
Figure 6B:
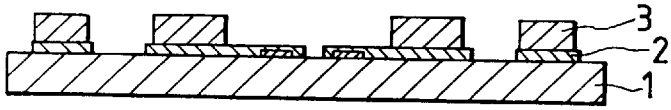
FIG. 6B PRIOR ART
Figure 6C:
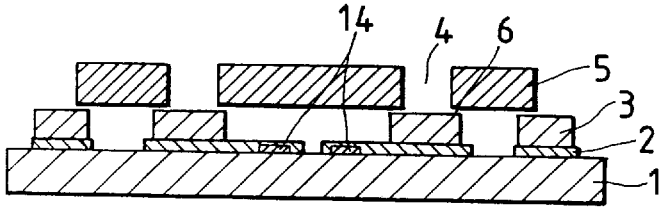
FIG. 6C PRIOR ART
Figure 6D:
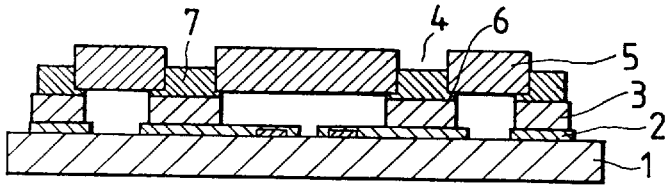
FIG. 6D PRIOR ART
Figure 6E:
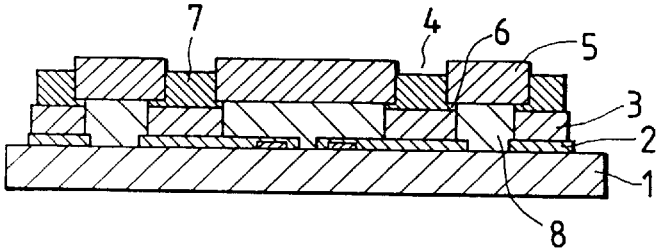
FIG. 6E PRIOR ART
Figure 6F:
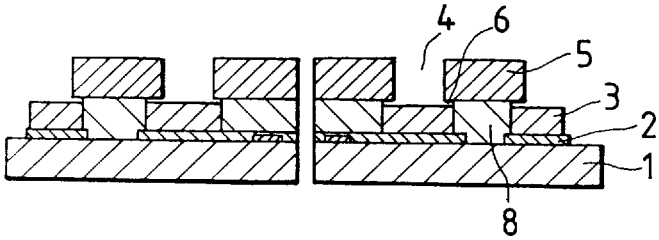
FIG. 6F PRIOR ART
Figure 6G:
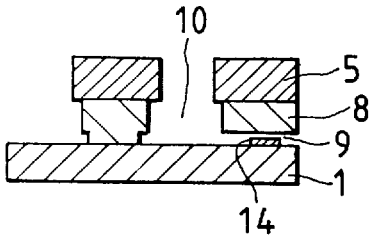
FIG. 6G PRIOR ART

As shown in FIG. 4G, the solid layer 2 is removed by using ethylcellosolve as the removal liquid to obtain a discharging portion and an ink liquid path.

According to the above steps, the ink-jet recording head of the present invention is completed.

EXAMPLE 4

Although the cold-curable resin 8 was injected into the gap by capillarity in Example 3, the resin may be preferably performed by suction from the second opening portion.

For example, after sufficiently dropping the cold-curable resin 8 in the first opening portion 4, the cold-curable resin 8 dropped is sucked from the second opening portion 4' while controlling the suction force by leak valve or the like, the second opening portion 4' being connected via a jig having a simple sealing means such as rubber cap with a simple vacuum pump of diaphragm type or the like.

Next, when the liquid level of the cold-curable resin 8 in the first opening portion 4 is reduced by the suction, the reduced amount of the resin is supplied into the first opening portion 4.

By the above process, even a curable resin having a remarkably high viscosity can be injected into the gap and is not leaked outside.

Although the cold-curable resin was used as the curable resin 8, it is not limited thereto and any resin can be used provided that it can be cured later. For example, a thermo-curable (thermosetting) resin, a thermoplastic resin and a photo-curable resin can be preferably used.

Although in Examples of the present invention the cold-curable resin was used as the curable resin, the another preferable process for producing an ink-jet recording head may be used in which the second supporting member made of ultraviolet (UV) ray-transmissive material such as glass or acrylic resin is used, an epoxy type UV ray-curable resin is injected as the curable resin, and the resin is cured by irradiated with UV ray from the above of the second supporting member because the resin can be cured for a short time without the limitation of hot life of the resin.

As the cutting means for forming the ink-supply opening and the ink common liquid chamber, the diamondsaw was used, but a cutting tool such as end mill can be preferably used.

What is claimed is:

1. A process for producing an ink-jet recording head, comprising the steps of:

forming a solid layer in a space for forming a liquid path and a part of a liquid chamber on a first supporting member having thereon a discharge pressure-generating element used for discharging an ink;

forming an opening portion at a position for forming an ink-supply opening in a second supporting member;

placing the second supporting member above the first supporting member;

providing a curable or thermoplastic resin for forming walls of the liquid path and the liquid chamber onto the first supporting member so that the solid layer formed on the first supporting member is covered with the resin;

curing the resin in such a state that the resin is interposed between the first and second supporting members;

cutting from above the cured resin of the opening portion formed in the second supporting member until the solid layer to form an ink-supply opening and at least a part of a common liquid chamber; and removing the solid layer to form the liquid path defined by the first supporting member and the resin.

2. The process for producing an ink-jet recording head according to claim 1, wherein the opening portion is formed before placing the second supporting member on the first supporting member.

3. The process for producing an ink-jet recording head according to claim 1, wherein after placing the second supporting member via a spacer on the first supporting member, the resin is injected into a gap between the first and second supporting members.

4. The process for producing an ink-jet recording head according to claim 1, wherein the section of the opening portion has a large length and a width larger than the width of cut in the cutting step.

5. The process for producing an ink-jet recording head according to claim 4, wherein after placing the second supporting member via a spacer on the first supporting member, the resin is injected through the opening portion into a gap between the first and second supporting members.

6. The process for producing an ink-jet recording head according to claim 5, wherein injection of the resin is performed by capillarity.

7. The process for producing an ink-jet recording head according to claim 5, wherein injection of the resin is performed under reduced pressure.

8. The process for producing an ink-jet recording head according to claim 1, further comprising before the cutting step, filling the opening portion with the resin to close the opening portion.

9. The process for producing an ink-jet recording head according to claim 8, wherein the second supporting member is made of a metal and the cutting in the cutting step is performed so that the resin remains on an inner wall of the opening portion.

10. A process for producing an ink-jet recording head, comprising the steps of:

preparing a first supporting member having thereon a discharge pressure-generating element used for discharging an ink;

forming a solid layer in a space for forming a liquid path and a part of a liquid chamber on the first supporting member;

providing at least one of a curable and thermoplastic resin for forming walls of a liquid path and the liquid chamber onto the first supporting member so that the solid layer formed on the first supporting member is covered with the resin;

curing the resin;

cutting from the cured resin until the solid layer to form an ink-supply opening and at least a part of a common liquid chamber; and removing the solid layer to form the liquid path defined by the first supporting member and the resin.

11. A process for producing an ink-jet recording head, comprising the steps of:

preparing a first supporting member having thereon a discharge pressure-generating element used for discharging an ink;

forming a solid layer in a space for forming a liquid path and a part of a liquid chamber on the first supporting member;

preparing a second member having an opening portion at a position for forming an ink-supply opening;

providing at least one of a curable and thermoplastic resin for forming walls of the liquid path and the liquid chamber onto the first supporting member so that the solid layer formed on the first supporting member is covered with the resin;

placing the second supporting member on the resin;

curing the resin in such a state that the resin is interposed between the first and second supporting members;

cutting from above the cured resin of the opening portion formed in the second supporting member until the solid layer to form an ink-supply opening and at least a part of a common liquid chamber; and removing the solid layer to form the liquid path defined by the first supporting member and the resin.

* * * * *

UNITED STATES PATENT AND TRADEMARK OFFICE

CERTIFICATE OF CORRECTION

PATENT NO. : 6,041,501
DATED : March 28, 2000
INVENTOR(S) : Toshio Suzuki et al.

It is certified that error appears in the above-identified patent and that said Letters Patent is hereby corrected as shown below:

Title page,
Item [56] References Cited,
U.S. PATENT DOCUMENTS, insert

| | | | | |
|---|---|---|---|---|
| -- 4509063 | 4/1985 | Sugitani et al. | 346 | 140 R |
| 4521787 | 6/1985 | Yokota et al. | 346 | 140 R |
| 4609427 | 9/1986 | Inamoto et al. | 156 | 633 |
| 4666823 | 5/1987 | Yokota et al. | 430 | 320 |
| 5030317 | 7/1991 | Noguchi | 156 | 630 |
| 5126768 | 6/1992 | Nozawa et al. | 346 | 140 R |
| 5347713 | 9/1994 | Shibata et al. | 29 | 890.1 |
| 5491505 | 2/1996 | Suzuki et al. | 347 | 203 --; and |

FOREIGN PATENT DOCUMENTS, insert
-- 62-253457 11/1987 Japan -- and
"4191053 should read -- 4-191053
5147218" 5-147218 --.

Item [57] ABSTRACT,
Line 16, "the above" should read -- above --.

Column 2,
Line 13, "waving" should read -- unevenness --;
Line 39, "heads" should read -- head --;
Line 44, "has still" should read -- still has --;
Line 56, "as," should read -- as --; and
Line 57, "conditions," should read -- many conditions, --.

Column 3,
Line 6, "steps:" should read -- steps of: --; and
Line 19, "the above" should read -- above --.

Column 4,
Line 10, "head" should read -- heads --;
Line 11, "cost down." should read -- cost decreases --;
Line 60, "where will" should read -- where it will --; and
Line 67, "A dicing tape" should read -- A tape --.

Column 5,
Line 43, "the above" should read -- above --.

UNITED STATES PATENT AND TRADEMARK OFFICE

CERTIFICATE OF CORRECTION

PATENT NO. : 6,041,501
DATED : March 28, 2000
INVENTOR(S) : Toshio Suzuki et al.

It is certified that error appears in the above-identified patent and that said Letters Patent is hereby corrected as shown below:

Column 6,
Line 37, "lager" should read -- larger --.

Column 7,
Line 30, "the another" should read -- another --;
Line 37, "irradiated" should read -- being irradiated -- and "the above of" should read -- above --;
Line 41, "diamondsaw" should read -- diamond saw --.

Column 8,
Line 32, "comprising" should read -- comprising, --.

Signed and Sealed this

Twenty-fifth Day of December, 2001

*Attest:*

*Attesting Officer*

JAMES E. ROGAN
*Director of the United States Patent and Trademark Office*